US007306241B2

(12) United States Patent
Cunningham et al.

(10) Patent No.: US 7,306,241 B2
(45) Date of Patent: Dec. 11, 2007

(54) STRAP FOR SNOWBOARD BOOTS OR BINDINGS

(75) Inventors: Christopher Cunningham, Burlington, VT (US); Christopher Doyle, Burlington, VT (US); Gregory Dean, Shelburne, VT (US); Scott Keller, Waterbury, VT (US); Florian Lang, Colchester, VT (US)

(73) Assignee: The Burton Corporation, Burlington, VT (US)

( * ) Notice: Subject to any disclaimer, the term of this patent is extended or adjusted under 35 U.S.C. 154(b) by 82 days.

(21) Appl. No.: 11/215,827

(22) Filed: Aug. 29, 2005

(65) Prior Publication Data

US 2007/0045989 A1 Mar. 1, 2007

(51) Int. Cl.
*A63C 9/18* (2006.01)

(52) U.S. Cl. ..... 280/14.23; 280/14.22; 280/14.24; 280/611; 280/623; 280/626; 280/629

(58) Field of Classification Search ..... 280/14.23, 280/14.22, 14.24, 611, 623, 24, 626, 629
See application file for complete search history.

(56) References Cited

U.S. PATENT DOCUMENTS 3,258,820 A 7/1966 Steinberg
3,614,119 A 10/1971 Wilkes
3,643,295 A 2/1972 Scholch
3,662,435 A 5/1972 Allsop
3,897,077 A 7/1975 Schweizer
4,165,887 A 8/1979 Bunn, Jr.
4,207,776 A * 6/1980 Helt et al. ..... 474/205
4,408,403 A 10/1983 Martin (Continued)

FOREIGN PATENT DOCUMENTS

DE 4120805 A1 1/1992

(Continued)

*Primary Examiner*—Christopher P. Ellis
*Assistant Examiner*—Cynthia F. Collado
(74) *Attorney, Agent, or Firm*—Wolf, Greenfield & Sacks P.C.

(57) ABSTRACT

A binding or boot strap is provided that allows a rider to easily, rapidly and/or effectively tighten and/or loosen the strap about his or her boot. The strap includes a boot-engaging strap portion that engages with an engagement strap coupleable to the boot, as may be the case with boots used for step-in bindings, or to the binding, as may be the case with strap-type bindings. An arrangement for facilitating tightening/loosening of the two strap pieces so that a rider can slip his or her foot into or out from the boot or fasten the boot to or loosen it from a snowboard binding is also provided. In one embodiment, this arrangement includes a tightening element, such as for example a cord, lace or strap, suitably coupled to one or both strap portions such that a rider can pull on the tightening element to move the strap pieces relative to each other and tighten the strap. The tightening arrangement may be configured with a mechanical advantage whereby the force applied to the tightening element results in a greater force applied to the strap. To take up any excess amount of tightening element after the strap has been tightened, a retraction device, such as a self-winding spool, may be utilized. To separate the strap from the boot or binding, a hook and catch arrangement may be employed.

57 Claims, 8 Drawing Sheets

U.S. PATENT DOCUMENTS 4,546,521 A * 10/1985 Ribarits ..... 27/70 SK
4,654,985 A 4/1987 Chalmers
4,677,768 A 7/1987 Benoit et al.
4,735,004 A 4/1988 Dodge
4,754,560 A 7/1988 Nerrinck
4,757,621 A 7/1988 Iwama
4,765,069 A 8/1988 Baggio et al.
4,767,127 A 8/1988 Olivieri
4,788,781 A 12/1988 Benoit et al.
4,802,291 A 2/1989 Sartor
4,811,503 A 3/1989 Iwama
4,852,222 A 8/1989 Courvoisier et al.
4,915,400 A 4/1990 Chambers
4,922,634 A 5/1990 Seidel
4,937,952 A 7/1990 Olivieri
4,969,278 A 11/1990 Ottieri
5,026,087 A 6/1991 Wulf et al.
5,152,038 A 10/1992 Schoch
5,158,559 A 10/1992 Pozzobon et al.
5,190,311 A * 3/1993 Carpenter et al. ..... 280/618
5,249,377 A 10/1993 Walkhoff
5,362,087 A 11/1994 Agid
5,412,883 A 5/1995 Wulf et al.
5,416,987 A 5/1995 Bemis et al.
5,435,080 A * 7/1995 Meiselman ..... 36/117.1
5,566,474 A 10/1996 Leick et al.
5,586,367 A * 12/1996 Benoit ..... 24/68 SK
5,640,787 A 6/1997 Spademan
5,647,104 A 7/1997 James
5,661,958 A 9/1997 Glass et al.
5,692,765 A 12/1997 Laughlin
5,713,587 A 2/1998 Morrow et al.
5,727,337 A 3/1998 Okajima
5,791,021 A 8/1998 James
5,791,068 A 8/1998 Bernier et al.
5,810,381 A 9/1998 Keller et al.
5,829,169 A 11/1998 James
5,836,093 A 11/1998 Gallay
5,839,210 A 11/1998 Bernier et al.
5,845,371 A 12/1998 Chen
5,857,700 A * 1/1999 Ross ..... 280/623
5,918,387 A 7/1999 Emerson
5,933,985 A 8/1999 James
5,934,599 A 8/1999 Hammerslag
5,983,530 A 11/1999 Chou
6,009,638 A 1/2000 Maravetz et al.
6,024,375 A 2/2000 Johnson
6,032,387 A 3/2000 Johnson
6,056,300 A 5/2000 Carpenter et al.
6,056,312 A 5/2000 Hogstedt
6,062,586 A 5/2000 Korman
6,065,770 A 5/2000 Hansen et al.
RE36,800 E 8/2000 Vetter et al.
6,119,372 A 9/2000 Okajima
6,189,913 B1 2/2001 Morrow et al.
6,202,953 B1 3/2001 Hammerslag
6,213,493 B1 4/2001 Korman
6,250,651 B1 6/2001 Reuss et al.
6,267,390 B1 7/2001 Maravetz et al.
6,276,708 B1 8/2001 Hogstedt
6,289,558 B1 9/2001 Hammerslag
6,293,577 B1 9/2001 Shields
6,336,650 B1 1/2002 Alspaugh
6,347,436 B1 2/2002 Barber et al.
6,397,496 B1 6/2002 Seymour
6,416,074 B1 7/2002 Maravetz et al.
6,467,194 B1 10/2002 Johnson
6,568,103 B2 5/2003 Durocher
6,669,211 B2 12/2003 Gonthier
2001/0002518 A1 6/2001 Morrow et al.
2001/0009320 A1 7/2001 Couderc et al.
2002/0095750 A1 7/2002 Hammerslag
2003/0038472 A1 2/2003 O'Connell et al.
2003/0204938 A1 11/2003 Hammerslag
2004/0061311 A1 4/2004 De Bortoli et al.
2004/0113392 A1 6/2004 Elkington
2004/0155433 A1 8/2004 Sanders
2004/0159017 A1 8/2004 Martin
2004/0169350 A1 9/2004 Elkington
2004/0200098 A1 10/2004 Martin et al.
2004/0250445 A1 12/2004 Pritchett
2004/0262887 A1 12/2004 Bianchi Bazzi

FOREIGN PATENT DOCUMENTS

DE 2603009 A1 8/1997
EP 0561387 A1 9/1993
FR 2840224 A1 12/2003
JP 8-57108 3/1996
JP 10179836 7/1998
WO WO89/10167 A1 11/1989
WO WO97/26052 A1 7/1997
WO WO97/31687 A1 9/1997
WO WO97/38764 A1 10/1997
WO WO99/60878 A1 12/1999

* cited by examiner

STRAP FOR SNOWBOARD BOOTS OR BINDINGS

BACKGROUND OF INVENTION

1. Field of Invention

The invention relates to straps for snowboard boots and snowboard bindings.

2. Discussion of Related Art

Strap type bindings for securing a snowboard boot of a rider to a snowboard are known and typically include one or more straps, such as an ankle strap and/or a toe strap, which may be tightened across the top of the boot to firmly secure the rider to the binding. Similar straps are used to at least partially secure a rider's foot within a boot in many step-in binding systems. Conventional straps (e.g., for a binding or step-in boot) include an elongated strip, slightly bowed, that extends across the top of the boot. The elongated strip includes a ratchet buckle that engages ratchet teeth of a free end of a mating serrated strap to allow the rider to incrementally tighten strap down over the boot. The strap pieces may be loosened or separated from each other, typically by disengaging a locking pawl from the serrated strap.

SUMMARY OF INVENTION

In one embodiment, an apparatus comprising a strap a tightening element is provide. The strap includes a boot-engaging strap piece, a locking element coupled to the boot-engaging strap piece and an engagement strap that engages with the locking element in one of a plurality of positions. The tightening element is constructed and arranged to pull the locking element relative to the engagement strap to tighten the strap about a snowboard boot.

In another embodiment, an apparatus comprising a strap a tightening element is provide. The strap includes a locking element coupled to the boot-engaging strap piece and an engagement strap that engages with the locking element in one of a plurality of positions. The tightening element is coupled to the strap and constructed and arranged to tighten the strap about a snowboard boot. The tightening element is disposed exclusively on or within the strap.

In yet another embodiment, an apparatus comprising a snowboard binding and a snowboard binding strap is provide. The snowboard binding includes a baseplate and a highback attached to the baseplate. The snowboard binding strap is attached to the binding. The binding strap includes a tightening element constructed and arranged to tighten the binding strap about a boot via tensioning of the tightening element. The tightening element is operatively coupled to the binding strap and the base without an operative coupling to the highback.

In still another embodiment, an apparatus having a strap and a tightening element is provided. The tightening element is operatively coupled to the strap. The tightening element has a first portion, wherein the strap is tightenable by tensioning the tightening element. A retraction device is coupled to the tightening element and is adapted to gather the first portion of the tightening element.

In another embodiment, a snowboard binding is provided. The binding includes a baseplate and a strap coupleable to the baseplate. The strap includes a boot-engaging strap piece, a locking element coupled to the boot-engaging strap piece, and an engagement strap piece that engages with the locking element. A tightening element is coupled to the locking element. The tightening element is constructed and arranged to pull the locking element relative to the engagement strap to tighten the strap about a snowboard boot. The tightening element is routed through a path configured to provide a mechanical advantage in tightening the strap about the boot when the tightening element is pulled, whereby a first force applied on the tightening element results in a second force on the strap. The second force is greater than the first force. A gathering device is configured to gather a portion of the tightening element.

In another embodiment, an apparatus is provided. The apparatus has a snowboard binding a first binding strap constructed and arranged to engage a snowboard boot and at least partially secure the boot to the binding, and a first tightening element coupled to the first binding strap. The first binding strap comprising an engagement strap configured as a serrated strap. A first tightening element path is provided and is configured to provide a mechanical advantage in tightening the first binding strap about a boot when the first tightening element is pulled, whereby an applied force applied on the first tightening element results in a resultant force on the first binding strap that is greater than the applied force.

In still another embodiment, an apparatus having a strap, a first tightening element and at least one guide element is provided. The strap is constructed and arranged to engage a snowboard boot. The strap includes a boot-engaging strap piece and an engagement strap piece. The first tightening element is coupled to the strap to tighten the strap about the boot. At least one guide element is arranged on the strap. The first tightening element path travels around the at least one guide element in a manner to provide a mechanical advantage in tightening the strap about a boot when the first tightening element is pulled, whereby an applied force applied on the first tightening element results in a resultant force on the strap that is greater than the applied force.

In still another embodiment, a method of preparing a snowboard binding apparatus for insertion or removal of a boot is provided. The snowboard binding apparatus including a base, a boot-engaging strap and an engagement strap. The method includes grasping at least one of the boot-engaging strap and the engagement strap and unhooking an end of the engagement strap from the binding apparatus base so as to free the end from the binding apparatus base by an amount sufficient for insertion or removal of the boot.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
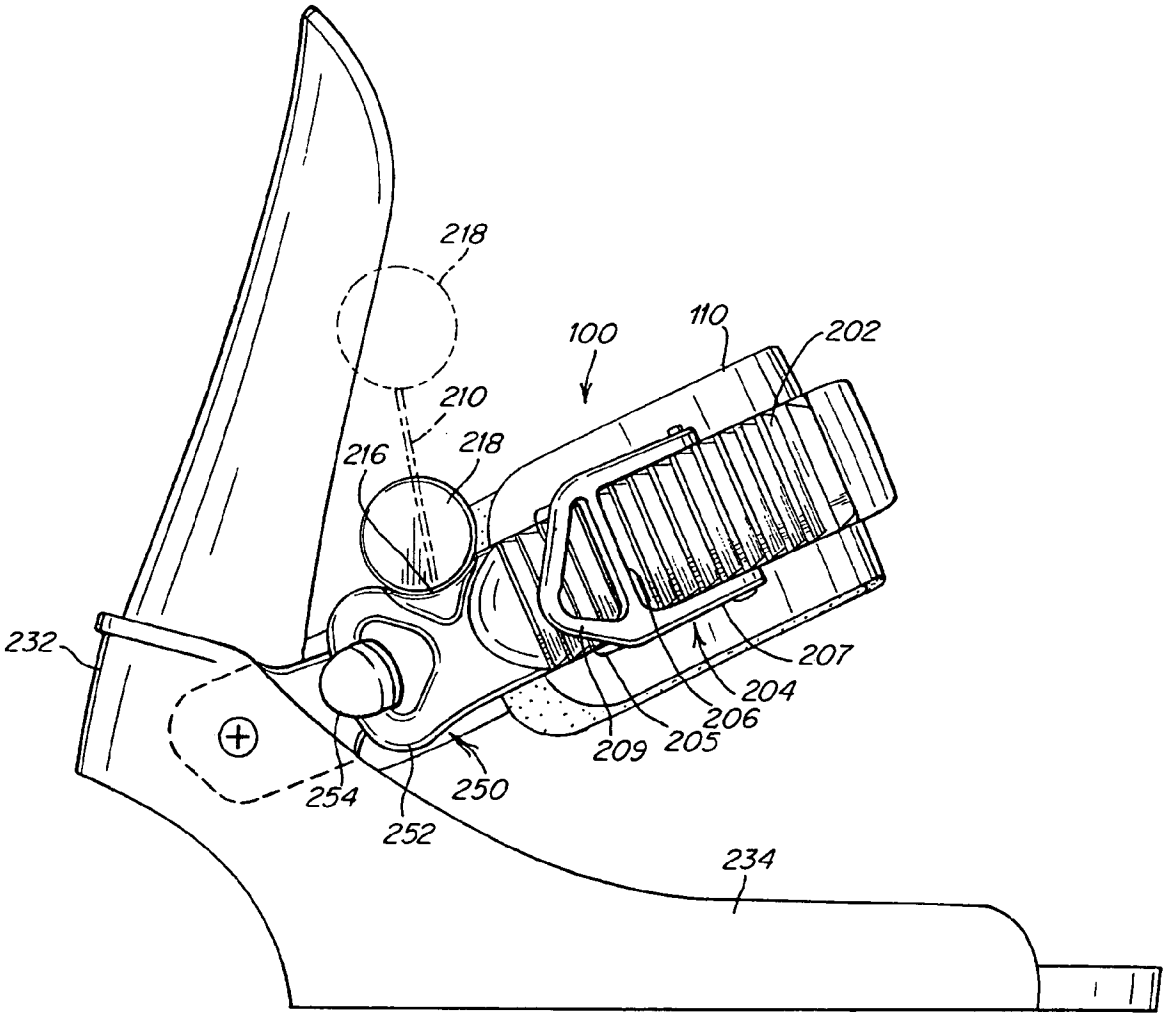
FIG. 1A is a side view of a strap, in accordance with one illustrative embodiment, configured as a binding strap.

Embodiments of the invention described herein are not limited in their application to the details of construction and the arrangement of components set forth in the following description or illustrated in the drawings. Other embodiments are capable of being practiced or carried out in different ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

In one embodiment, a strap for a snowboard binding or snowboard boot is provided with one or more features, which may be utilized alone or in any suitable combination, that allow a snowboard rider to easily, rapidly and/or effectively tighten and/or loosen the strap about his or her boot. The strap may include a boot-engaging strap piece, configured as an elongated strip that may be slightly bowed and that is adapted to extend across the top of a snowboard boot. The boot-engaging strap piece (which optionally may be padded and thus may be referred to as a padded strap piece) engages with an engagement strap piece coupleable to the boot (e.g., a step-in binding boot), or to the binding, as may be the case with strap-type bindings. The boot-engaging strap piece and mating engagement strap include one or more arrangements for facilitating tightening/loosening of the two strap pieces so that a rider can slip his or her foot into or out of the boot, or fasten the boot to or loosen it from a snowboard binding or component thereof. The resulting strap may be configured to hold a boot in the binding or a rider's foot in the boot and impart sufficient retention of the boot and/or foot to withstand the forces exerted while snowboard riding. The strap may further include a mounting strap that adjustably mounts to the boot-engaging strap.

According to one aspect of the invention, the strap includes an arrangement for incrementally tightening the boot-engaging strap and the engagement strap, thereby securing the strap to the boot or binding. The tightening arrangement includes a tightening element (e.g., a cord, lace, or strap, although the invention is not limited in this respect) suitably coupled to one or both strap pieces such that a rider can pull on the tightening element to move the strap pieces relative to each other and tighten the strap. In this manner, a rider merely reaches for the tightening element and pulls it, much like pulling on a footwear lace. Because the tightening element is coupled to one or both strap pieces, they are pulled or moved toward each other to effect closure. The strap pieces are held in the tightened position with a suitable releasable locking arrangement.

As will be described in greater detail below, in one embodiment the boot-engaging strap piece includes a locking element that engages with the engagement strap piece. Of course, the present invention is not limited in this regard, as the locking element may be disposed on the mating engagement strap piece rather than on the boot-engaging strap piece. The tightening element is anchored to the locking element and when the free end of the tightening element is pulled, the locking element is drawn over the opposite strap piece and locks the engagement strap to the boot-engaging strap. In one embodiment, the tightening element draws the boot-engaging strap piece and the engagement strap piece relative to each other in a manner the whereby little or no twisting moment toward the surface of the boot-engaging strap piece is created at the connection of the two strap pieces.

In one embodiment, the tightening element is housed entirely on or within the strap so that no portion of the tightening element, except for the free end that is to be pulled to tighten the strap, engages with other components of the boot and/or binding. It should be appreciated that the present invention is not limited to pulling an end of the tightening element. Rather any portion of the tightening element to impart the desired motion and/or tension may be pulled. In one embodiment, the tightening element is not itself responsible for keeping the two strap pieces tight relative to each other. Rather, according to an aspect of the invention, the tightening element merely facilitates moving one strap piece relative to the other. Once the desired tightness is achieved, the tension on the tightening element may be relieved and the straps are held fast via a releasable locking arrangement and/or element between the straps.

The tightening element may be coupled to the strap piece(s) in a manner such that pulling on the tightening element corresponds directly to the amount of tension in the strap. Alternatively, according to another aspect of the invention, the tightening arrangement is configured to provide a mechanical advantage, whereby the amount of force exerted to tighten the strap is less than the amount of tension in the strap. That is, a force applied to the tightening element results in a greater force applied to the strap. In one embodiment, the tightening element is routed through a path configured in a manner whereby the force to pull the tightening element is reduced while the amount of travel of the tightening element is increased. In this regard, while the force applied to the tightening element is relatively low, the amount of work (i.e., force multiplied by distance) necessary to tighten the strap is the same as if no mechanical advantage were provided. Yet, to a user, the effort necessary to tighten the strap is low. In one embodiment, this mechanical advantage may be accomplished by routing the tightening element about suitable capstans, posts, pins, pulleys or other structures used separately or together, as will be described in further detail below.

In one embodiment, the mechanical advantage provides a 2:1 ratio of resulting force to applied force (that is, the force acting between the strap components in the tightening direction to the force required to pull on the tightening element). In another embodiment, the mechanical advantage provides a 3:1 ratio. In yet another embodiment, the mechanical advantage provides a 4:1 ratio. It should be appreciated that the invention is not limited in this respect, as other suitable ratios may be provided, including for example, 1.5:1; 2.5:1; 3.5:1, etc. Thus, according to this aspect of the invention, any mechanical advantage of greater than 1:1 (that is, where the resulting force is greater than the applied force) may be employed, as the present invention is not limited in this regard. Further, in applications where two or more straps are used to secure a boot, each strap may have the same or different mechanical advantages. For example, in one embodiment, a snowboard binding ankle strap utilizes a 3:1 ratio whereas the toe strap utilizes a 2:1 ratio, although the invention is not limited in this regard and different ratios including ratios where the mechanical advantage provided on the toe strap is greater than that provided on the ankle strap may be employed.

Any free end of the tightening element generated after the strap is tightened can be stowed in a suitable manner. While the free length can be stowed in a pocket, tied up, wrapped around itself or another component or otherwise suitably stowed, according to one aspect of the invention, this free amount of tightening element is accommodated about a spool. In one embodiment, the free-end of the tightening element is coupled to the spool such that a rider can pull on the spool to tighten the strap. The spool may be a self-winding spool such that when the rider releases his or her grasp on the spool, the spool automatically gathers any excess amount of tightening element and retracts toward the strap. Alternatively, the spool may require manual actuation whereby, after the tightening element is drawn, the excess amount is manually wound around the spool.

To allow sufficient room to enable a rider to slip his or her foot into the boot or to allow the rider to insert the boot into the binding, the strap components typically spread apart by an adequate amount. As in conventional straps, this may be accomplished by separating the boot-engaging strap from the engagement strap. In one embodiment, however, these two strap pieces are coupled together via the tightening element. In such an embodiment, upon separating the two strap pieces, the tightening element coupled between the two strap pieces may become exposed, and the tightening element is long enough to create sufficient slack to enable the separation. According to one aspect of the invention, instead of separating the boot-engaging strap from the engagement strap, the rider may unhook an end of one of the straps from the mating component (e.g., boot or binding) so as to free the strap end from that component by an amount sufficient for insertion/removal of the foot from the boot or the boot from the binding. Once the foot is inserted in the boot, or the boot is inserted in the binding, the strap may be placed over the boot and re-hooked to the component. In one embodiment, a catch is disposed at an end of the engagement strap, and the catch is unhooked from, and hooked to, a hook that is disposed on the component. Alternatively, a hook may be provided on the engagement strap, and a corresponding catch may be provided on the mating component. In some embodiments, the hook or the catch may be provided at an end of the boot-engaging strap instead of or in addition to being provided at an end of the engagement strap. IN another embodiment, the hook or catch may be provided on the boot-engaging strap, and the other of the hook or catch may be provided on the engagement strap. In this regard, the boot-engaging strap and engagement strap may be separated from each other.

The above aspects of the invention may be employed in any suitable combination as the present invention is not limited in this respect. Also, any or all of the above aspects may be employed in a snowboard binding or snowboard boot; however, the present invention is not limited in this respect, and aspects of the invention may be used on any type of footwear or binding. Various aspects and embodiments of the invention will now be described in more detail with respect to the accompanying drawing figures. The invention is not, however, limited to the aspects and embodiments shown.

Figure 1B:
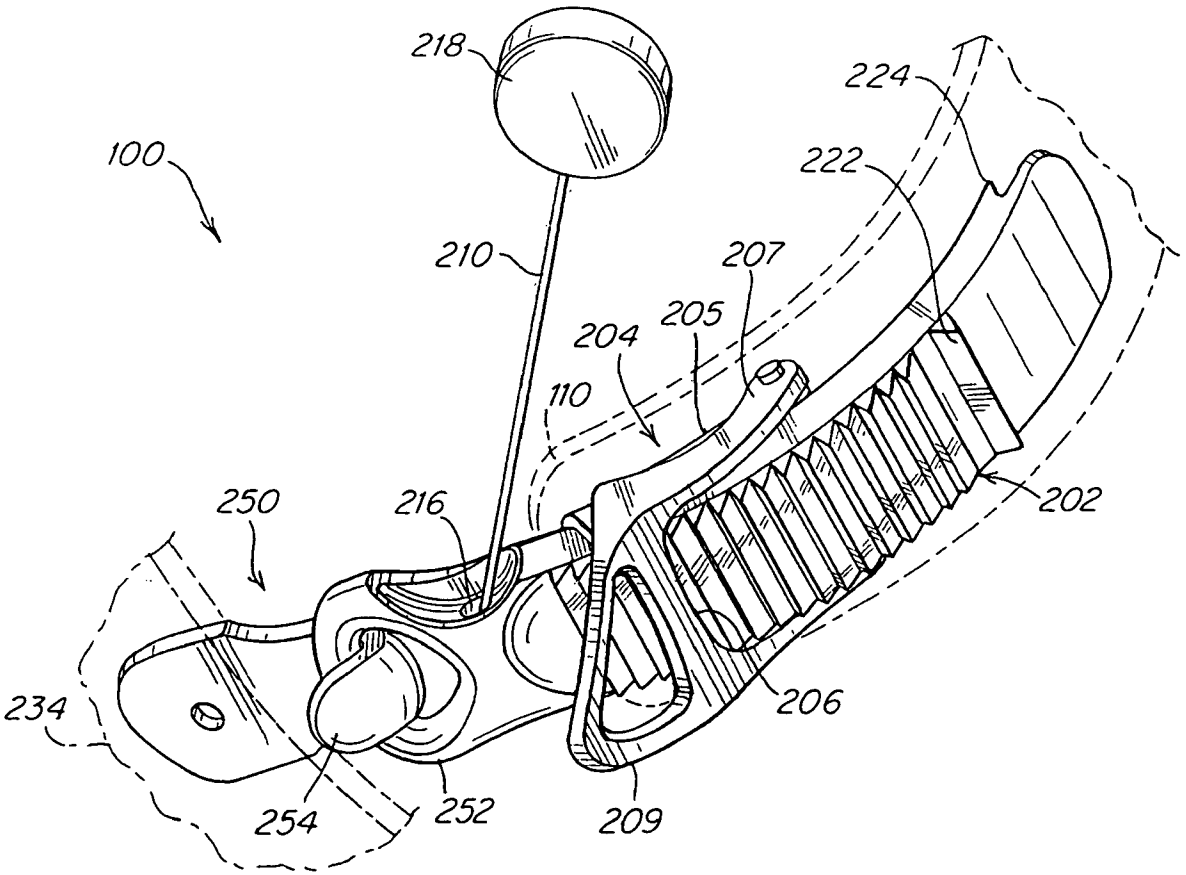
FIG. 1B is a perspective view of the strap of FIG. 1A.
Figure 1C:
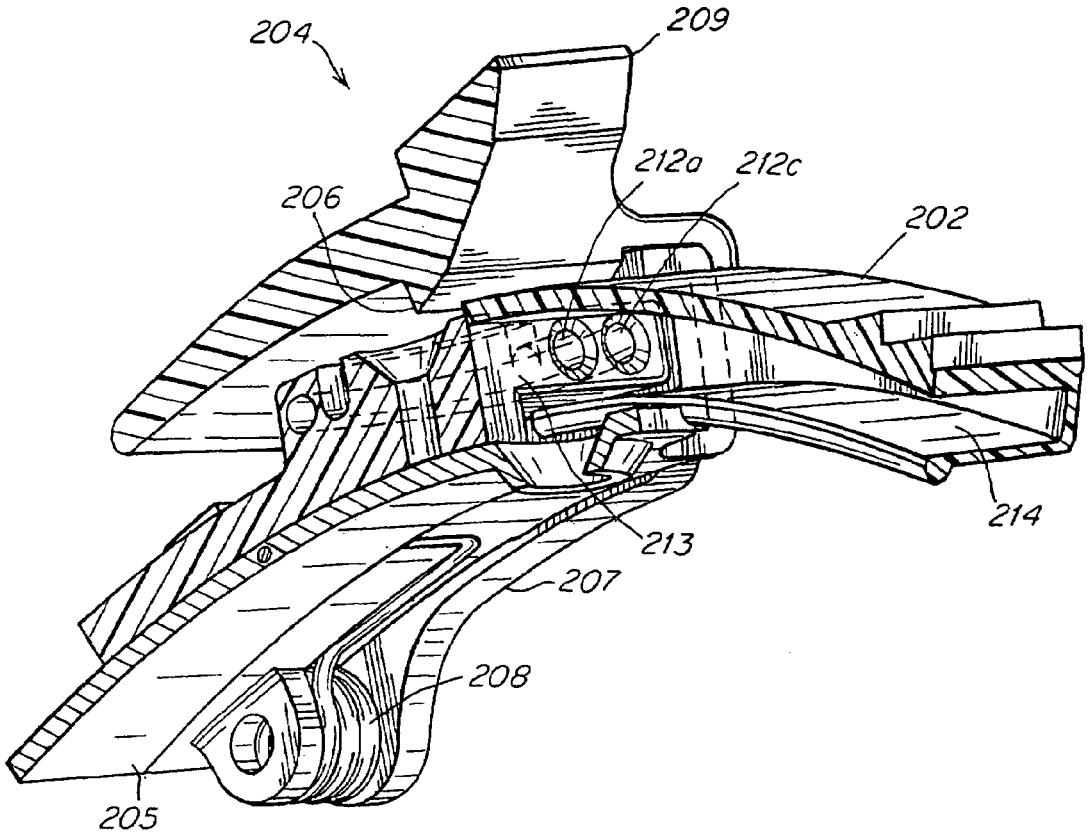
FIG. 1C is a perspective cut-away view of a portion of the strap of FIG. 1B.

A strap assembly 100 in accordance with one embodiment of the present invention, which incorporates several of the above-described aspects, is illustrated in FIGS. 1A–1C. The strap assembly 100 includes an engagement strap, such as serrated strap 202, and a locking element 204 that is attached to a boot-engaging strap 110, such as a padded strap, via a locking element base 205. Locking element 204 has a strap engagement element, such as a pawl 206 provided on a lever 207. Lever 207, and hence pawl 206, is biased toward serrations on serrated strap 202 by a spring 208 (see FIG. 1C). Locking element 204 may also include a release handle 209 for releasing pawl 206 from serrated strap 202, as will be described.

To tighten strap assembly 100 about a boot, such as a snowboard boot, a tightening element 210, which may be configured as a pull cord, is coupled to locking element 204. By tensioning pull tightening element 210, a rider pulls locking element 204 relative to serrated strap 202, thereby progressively tightening strap assembly 100 about a boot. In this regard, pawl 206 engages a tooth on the serrated strap to hold the strap pieces to each other in a locked fashion. According to an aspect of the invention, the strap is configured with a locking pawl than engages ratchet teeth of the serrated strap and a tightening element to tighten the pawl on the ratchet teeth, without a ratchet lever typically found in snowboard straps to tighten the strap.

In the illustrated embodiment, tightening element 210 is attached to a component of locking element 204; however, in other embodiments, the tightening element may be attached directly to boot-engaging strap 110, or coupled to the locking element in another suitable manner. In still other embodiments, tightening element 210 may be attached to the engagement strap (e.g., serrated strap 202) and configured to pull the engagement strap relative to the locking element.

Although a pull cord is shown in the illustrative examples, the present invention is not limited in this regard, as other suitable tightening elements, such as straps or laces may be employed.

To secure the tightening element 210 to locking element 204, in one embodiment, tightening element 210 is attached to element 213. Tightening element 210 travels from this attachment through an opening 212*a* and along and interior channel 214 formed in engagement strap 202. Opening 216 into channel 214 provides access to tightening element 210 such that the rider can pull the tightening element. In one embodiment, the tightening element exits the channel through the opening and is coupled to a pull element 218 to provide the rider with an element to grasp. In one embodiment, tightening element 218 terminates at the pull element 218; however, the present invention is not limited in this respect, as the pull element can be attached to the tightening element at any suitable location spaced from the end of the tightening element.

In the illustrated embodiment, to couple tightening element 210 to boot-engaging strap 110, an element, such as an anchor, is employed, and it is incorporated as a component of locking element 204. The present invention is not limited in this regards, and element 213 is not required, as tightening element 210 simply be anchored to locking element 204 or to boot-engaging strap 110, for example through a hole in either component. As mentioned above, tightening element 210 may be attached to another location on boot-engaging strap 110, or attached to serrated strap 202. Accordingly, element 213 or another anchoring feature may be provided separately from locking element 204—in some embodiments separately on the same strap, and in other embodiments, separately on a different strap.

In one embodiment, the tightening element draws the boot-engaging strap piece and the engagement strap piece relative to each other in a manner the whereby little or no twisting moment toward the surface of the boot-engaging strap piece is created at the connection of the two strap pieces. That is, the attachment location of the tightening element to the locking element is arranged so that the locking element does not pivot towards the surface of the boot-engaging strap piece when the strap is tightened. In one embodiment, the locking element sees no moment. In another embodiment, the locking element experiences a moment that is in a direction away from the surface of the boot-engaging strap piece.

In some instances, it may be desirable to prevent the serrated strap from disengaging entirely from the boot-engaging strap. Thus, in one embodiment, serrated strap 202 also includes a blocking element 224 that prevents serrated strap 202 from entirely disengaging from locking element 204. In the embodiment illustrated in FIG. 1B, if serrated strap 202 and locking element 204 are moved relative to each other by an amount such that serrated strap 202 is at risk of completely disengaging from locking element 204, the downward protrusion of blocking element 224 contacts a component of locking element 204 (for example, element 213 as shown in FIG. 1C) and prevents serrated strap 202 from exiting locking element 204. Of course, other manners of preventing the complete disengagement of locking element 204 and serrated strap 202 may be employed, and in some embodiments, complete disengagement is not prevented.

Pull element 218 may be a circular handle, or a handle of any suitable shape and may be made of any suitable material, although in some embodiments the outer components are made of plastic. For example, pull element 218 may be a handle that has a loop attached to the tightening element. Pull element 218 also may be a looped end of tightening element 210, such that a separate device is not provided at the end of tightening element 210.

The use of an engagement strap that lockably engages the locking element 204 allows the rider to incrementally tighten strap assembly 100. According to one aspect, the engagement strap and boot-engaging strap also carry the tension of the strap assembly when the tension on tightening element 210 is released. Thus, the loads placed on the strap during riding may be carried by strap assembly 100 in a manner similar to conventional ratchet strap configurations. By using the engagement strap and the locking element to hold the strap in tension, the rider may simply release the tightening element after tightening the strap, and the tightening element need not be locked or held in a tensioned state. In this regard, in one embodiment, the tightening element merely facilitates moving one strap piece relative to the other.

In one embodiment, the engagement strap is configured as a toothed strap (also referred to as serrated strap), with the teeth individually engaging with the pawl to hold the strap in a tightened state. However, it should be appreciated that the present invention is not limited to such a stepwise selection of tightening. While a serrated strap provides distinct levels of strap tightness which are selectable in small increments, the engagement strap may be configured to frictionally engage a locking pawl. In such an embodiment, the strap assembly can provide tightness selection in minute increments. Other suitable engagement strap and associated locking element configurations may be employed, as the present invention is not limited in this regard.

Tightening element 210 may be implemented in any one of numerous ways, and various embodiments of the present invention are not limited to any particular implementation. Tightening element 210 may be formed from a monofilament or a multistrand line. In accordance with one illustrative embodiment of the invention, tightening element 210 is formed of a low-friction material capable of supporting tensile force. In some embodiments, it may be advantageous to use a tightening element capable of withstanding a tensile force of 1,200 Newtons. A tightening element with any suitable outer diameter may be used, but in one embodiment, tightening element 210 has an outer diameter of approximately 1.2 mm. While not limited to any particular material or any particular form (e.g. woven, braided, twisted, monofilament, etc.), examples of materials that may be used for tightening element 210 include various types of natural or man-made fibers or fabrics, plastics, and/or metal. In one embodiment, tightening element 210 is a steel cable. In another embodiment, a tightening element comprising polyethylene may be used, for example, Spectra® brand fibers made by Honeywell International, Inc. In other embodiments, a steel cable, or other metal or non-metal cables, may be coated with a nylon coating, a fluoropolymer such as a Teflon® fluoropolymer coating, or other suitable coating.

In the embodiment illustrated in FIGS. 1A–1C, the snowboard binding and strap assembly are configured such that the tightening element and strap are self-contained, that is, the tightening element is disposed exclusively within the strap. For purposes herein, a tightening element is disposed exclusively on or within a strap when the tightening element is configured to substantially contact only the rider (when being pulled by the rider), the strap, and/or components disposed on the strap. For example, even though tightening element 210 extends out of the binding strap through strap opening 216 in the embodiment illustrated in FIGS. 1A and 1B, tightening element 210 is disposed exclusively within the binding strap because tightening element 210 does not contact a component (such as a post, a loop, a pulley, a capstan, or other guide element) that is disposed on the binding or the boot.

Figure 2:
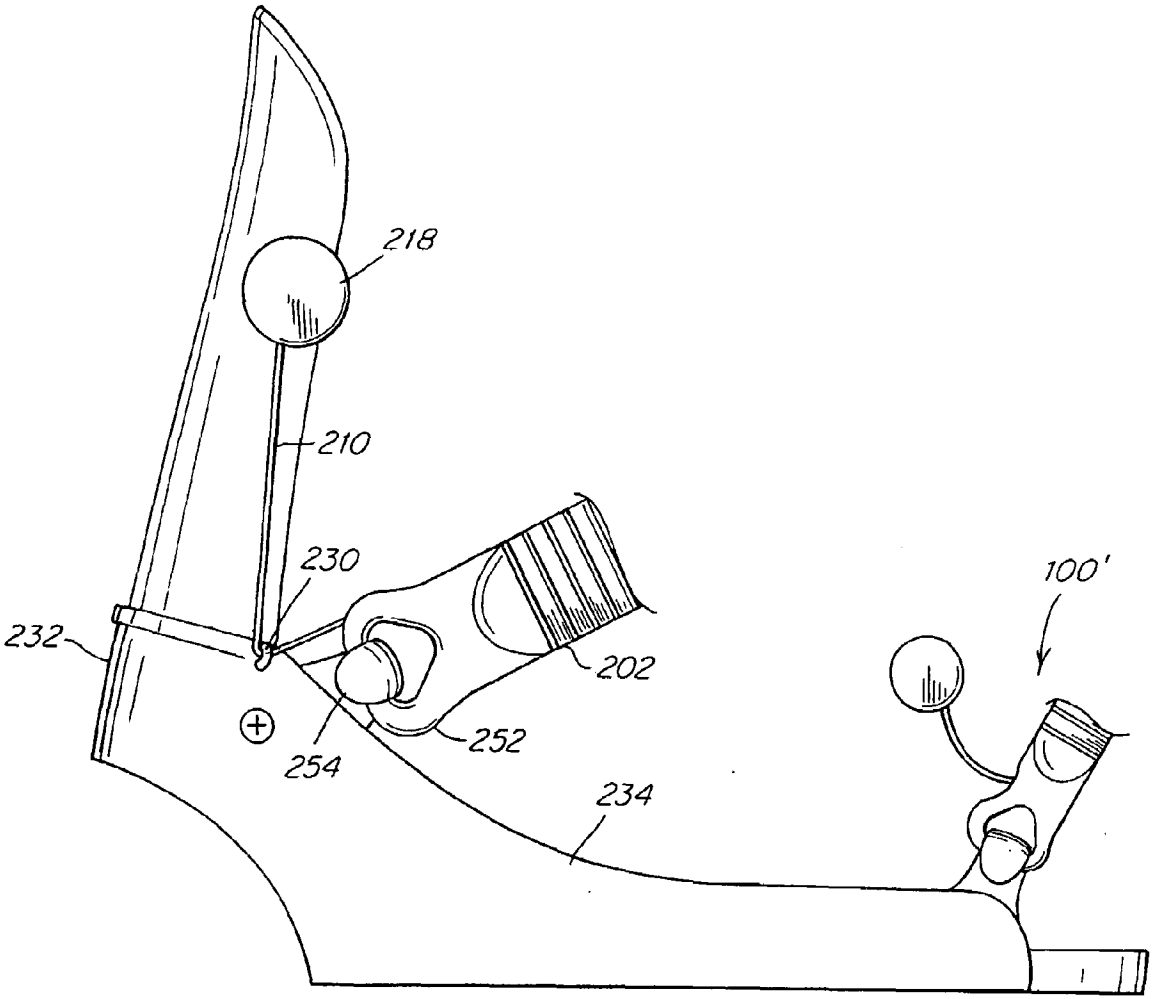
FIG. 2 is a side view of a binding incorporating ankle and toe straps with each strap being arranged in accordance with one embodiment.

Although the embodiment shown and described in FIGS. 1A and 1B is directed to a strap whereby the tightening element 210 is disposed exclusively within the strap, the present invention is not so limited and in other embodiments, the tightening element may engage other surrounding components. For example, in some embodiments, tightening element 210 may be routed via an element disposed on a baseplate sidewall, heel hoop or highback of the binding, as shown in FIG. 2. In this embodiment, a guide loop 230 forms a guide on heel hoop 232 of the binding, and tightening element 210 is routed through guide loop 230. The contact of tightening element 210 to guide loop 230 occurs between serrated strap 202 and pull element 218, and thus tightening element 210 is not disposed exclusively on or within the binding strap. In some embodiments, guide loop 230, or another suitable guide element, may be disposed on a baseplate sidewall 234 and no portion of the tightening element is operatively connected to the highback. A guide element also may be disposed on a boot in some embodiments.

Embodiments of the strap assembly described above are not limited for use as an ankle strap on a binding. As illustrated in FIG. 2, a strap assembly similar to strap assembly 100 of FIGS. 1A and 1B may be used as a toe strap on a binding. In this manner, two or more strap assemblies that incorporate features of the invention may be used on a single binding. In some embodiments, only the toe strap incorporates one or more of these features. In other embodiments, a boot for use with a step-in binding may include one or more straps that incorporate one or more of the features disclosed herein.

To reduce the force exerted to tighten strap assembly 100 about the boot in embodiments that employ tightening element 210, an arrangement that provides a mechanical advantage when pulling on tightening element 210 may be employed, whereby the force applied to the tightening element (e.g., tightening element 210) is less than the resulting force applied to the strap. One example of an arrangement that provides such a mechanical advantage is where the tightening element is routed about other guide elements, such as capstans, pins and/or pulleys in a manner that reduces the amount of force that a rider needs to use on tightening element, such as tightening element 210, to tighten strap assembly 100. In one embodiment, the strap is provided with at least one capstan, pin, post and/or pulleys.

Figure 3A:
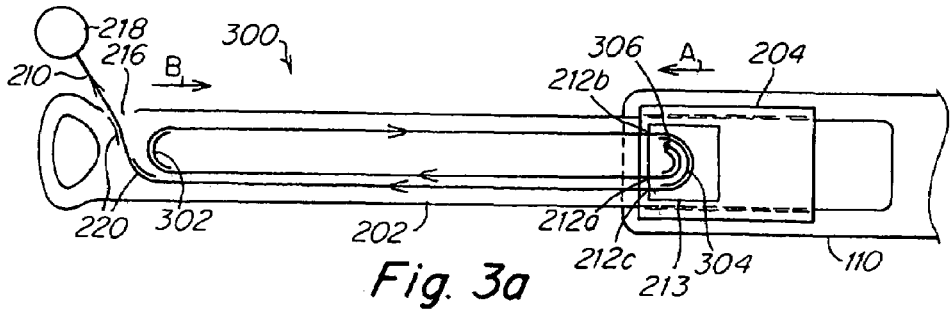
FIG. 3A is a diagrammatic representation of a strap according to one embodiment of the invention.

As shown in the diagrammatic representation of FIG. 3A, one embodiment of such a configuration that provides a mechanical advantage is illustrated generally by assembly 300. In this embodiment, a first end of tightening element 210 is attached to element 213 at a attachment location 306.

Element may be incorporated within locking element 204 as shown, or it may be attached to the boot-engaging strap or engagement strap at location separate from locking element 204.

From attachment location 306, tightening element 210 exits element 213 at opening 212*a* and travels around a first capstan 302 located within the interior channel of serrated strap 202. The tightening element re-enters element 213 through opening 212*b*, travels around a semi-circular path which forms a second capstan 304, and exits element 213 through opening 212*c*. The tightening element is directed toward strap opening 216 by walls 220 within serrated strap 202, where a portion of tightening element 210 is available for the rider to grasp.

In operation, the rider pulls on tightening element 210, which draws element 213, and thus the entire locking element, over serrated strap 202. The arrows shown on tightening element 210 indicate the direction of force applied to tightening element 210 when the rider pulls on pull element 218. Arrows A and B indicate the direction of movement of element 213 and serrated strap 202 relative to one another. As will be appreciated by those of skill in the art, because three support sections of tightening element are present between attachment location 306 and element 218 during pulling, a mechanical advantage of 3:1 is provided. That is, a force applied to the grasping portion of the tightening element results in a three-times greater resulting force applied to tighten the binding strap.

Figure 3B:
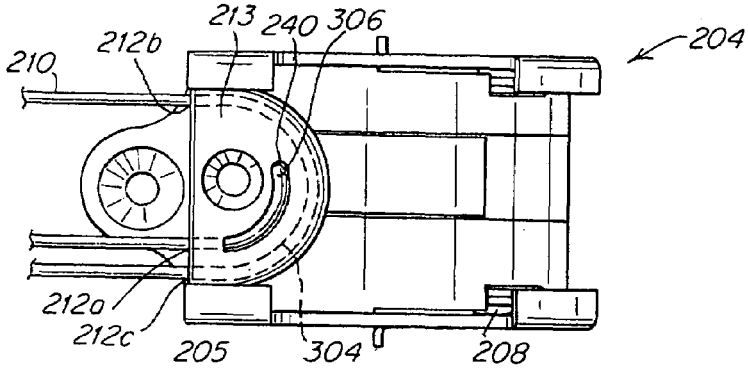
FIG. 3B is a top view of a portion of a strap according to one embodiment of the invention.
Figure 3C:
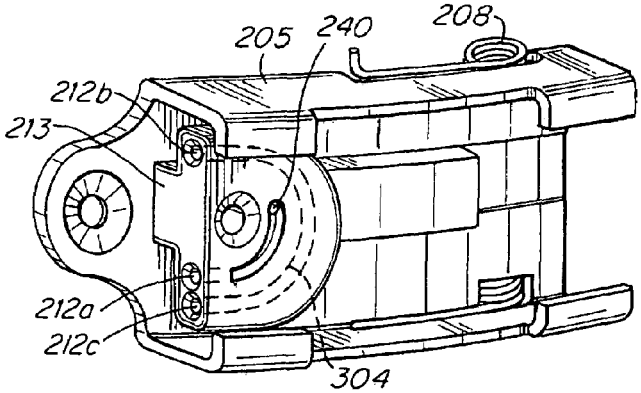
FIG. 3C is a perspective view of the portion of the strap of FIG. 3B.
Figure 3D:
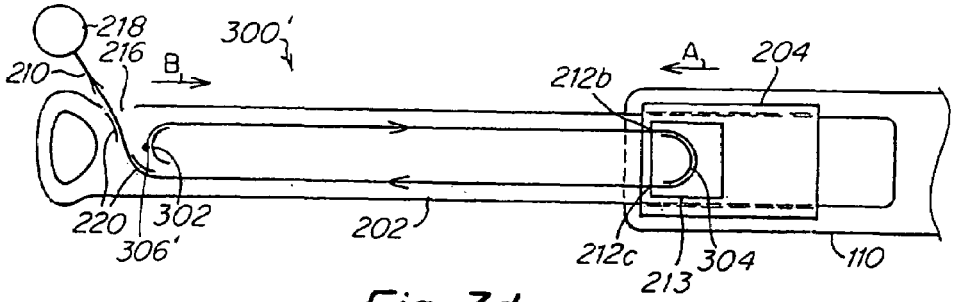
FIG. 3D is a diagrammatic representation of a strap according to an alternative embodiment of the invention.

As illustrated in FIG. 3D, an arrangement 300' may be provided in which a mechanical advantage ratio of 2:1 is achieved by attaching tightening element 210 to serrated strap 202 at a attachment location 306' instead of attaching tightening element 210 to element 213 which is attached to the padded strap. In this manner, two support sections of tightening element 210 exist between attachment location 306' and pull element 218, and thus this configuration 300' provides a mechanical advantage ratio of 2:1. Other suitable mechanical advantage ratios may be provided for the strap, as the present invention is not limited in this respect.

In some embodiments, both the ankle strap and a toe strap are configured to provide a mechanical advantage when tightening. The ankle strap and the toe strap may provide the same ratio of mechanical advantage, or they may provide different ratios of mechanical advantage. For example, an ankle strap may provide a mechanical advantage ratio of 3:1 while a toe strap may provide a mechanical advantage ratio of 2:1. Similarly, the ankle strap may be configured to provide a mechanical advantage ratio of 2:1, whereas the toe strap may be configured to provide a mechanical advantage ratio of 3:1. Other suitable mechanical advantage ratios may be provided for each strap (which may be the same ratio or different ratios), as the present invention is not limited in this respect.

FIGS. 3B and 3C illustrate a locking element base 205 and element 213 according to one embodiment of assembly 300. Tightening element 210 is attached to element 213 by passing tightening element 210 through a hole 240 and knotting or crimping tightening element 210 on the underside of hole 240. The manner in which tightening element 210 is attached at a attachment location is not intended to be limiting, and any suitable method may be used.

The particular shape or materials of construction of the capstans are not critical, and any suitable shape and/or material may be used. Preferably, in some embodiments, the capstans are made of a low-friction material, or include a low-friction coatings or surface, but such materials are not required. In the illustrated embodiment, semi-circular pathways having circular or semi-circular cross-sections are provided in components formed of molded resin, for example, Delrin® acetal resin. In some embodiments, the diameter of a capstan on the engagement strap is approximately 16 mm and the diameter of a capstan on the padded strap is approximately 20 mm, but any suitable sizes may be used for the capstans. In some embodiments, capstans having different shapes, such as elliptical shapes, may be used. For purposes herein, the term "capstan" is intended to include posts, pins, and other structures suitable for changing the direction of a tightening element without creating an unsuitable amount of friction.

Figure 3E:
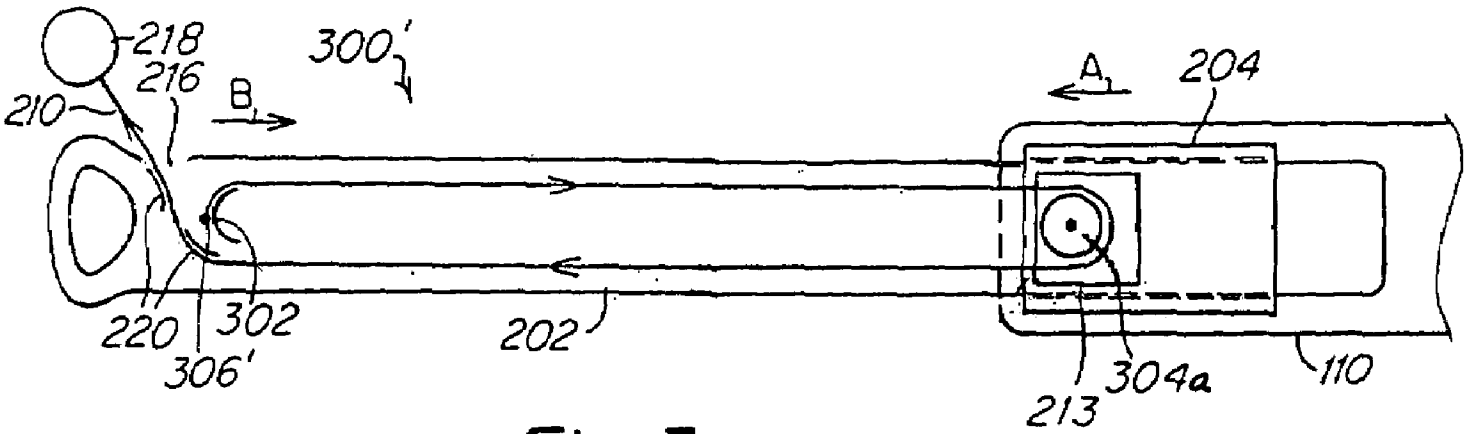
FIG. 3E is a diagrammatic representation of a strap according to an alternative embodiment of the invention.

Instead of non-rotatable capstans, rotatable pulleys, such as pulley 304a shown in FIG. 3*e*, may be used to define the path for tightening element 210. Such pulleys may be formed of the same materials, shapes, and sizes of the capstans. Of course, additional elements (capstans or pulleys) may be used such that a larger mechanical advantage is provided.

As described above, an excess length of tightening element 210 may be present after the binding strap has been tightened. According to one aspect of the invention, this excess amount of tightening element may be accommodated by a retraction device such as for example a spool. The spool may be incorporated within pull element 218, which can provide an extra benefit of holding pull element 218 against strap assembly 100.

FIG. 1A shows a pull element 218 in a retracted configuration (solid line) and also in a partially pulled configuration (dashed line). After the rider releases pull element 218, a retraction device incorporated within pull element 218 automatically gathers tightening element 210 and thus move pull element 218 until it makes contact with strap assembly 100, for example at serrated strap opening 216. In one embodiment, opening 216 is sized to receive a portion of pull element 218 therein so as to act as a seat for pull element 218. The retraction device may be a self-winding spool which automatically wraps excess tightening element around a spool contained within pull element 218. In embodiments which do not include guide elements that are disposed other than on the strap (for example guide loop 230 shown in FIG. 2), a self-winding spool may retract tightening element 210 until pull element 218 abuts the strap at strap opening 216, as illustrated in FIG. 1A.

Figure 4:
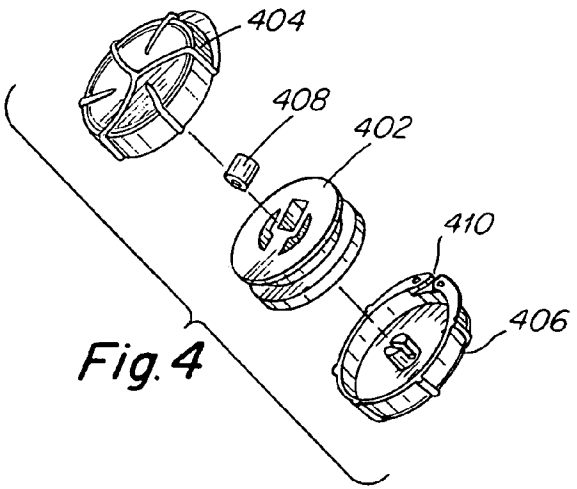
FIG. 4 is an exploded perspective view of the retraction device shown in FIGS. 1A and 1B.

One embodiment of a retraction device 400 is illustrated in FIG. 4. In this embodiment, retraction device 400 includes a handle base 404, a handle lid 406, and a spool 402. Spool 402 is self-winding by virtue of the rotational bias exerted on it by, for example, a clock spring (not shown). A crimp 408 secures tightening element 210 to spool 402, and tightening element 210 passes through an opening 410. Other suitable self-winding mechanisms may be employed, as the present invention is not limited in this regard.

The retraction device may operate automatically, such as with self-winding spool 402, or, in some embodiments, a spool or other retraction device may require the rider to actively retract the tightening element, such as, for example, by manually winding the spool. According to some embodiments, a retraction device may be used wherein the rider triggers a self-winding spool to operate. Other types of retraction devices and spools may be used including recoil mechanisms or other suitable devices.

As can be appreciated, retraction device imparts a force, albeit relatively small, to the tightening element and thus the serrated engagement strap portion. In some embodiments, the components through or about which the tightening element is routed are formed of low friction surfaces. When a rider wishes to loosen the strap, as mentioned above, the pawl is released and the engagement strap and the boot-engaging strap moved apart. However, when there is no resistance on the strap, the retraction device will impart some force tending to cause the strap to re-tighten. According to one embodiment, serrated strap 202 includes an impediment 222 to resist such self-closing movement of locking element 204 that may be caused by retraction device. When the strap has been loosened enough such that pawl 206 of locking element 204 is not within the serrated portion of serrated strap 202 (i.e., toward the left end of serrated strap 202 in FIG. 1B), impediment 222 may be used to resist the force applied to locking element 204 by the retraction device through tightening element 210. Impediment 222 has an inclined surface that is steeper and/or taller than the inclined surfaces of the plurality of serrations on serrated strap 202. Pawl 206 may be easily pulled over impediment 222 when a user pulls on tightening element 210, but impediment 222 provides enough resistance such that the force applied by the retraction device of pull element 218 cannot pull locking element 204 past impediment 222, and thus cannot inadvertently tighten the strap.

Instead of, or in addition to a self-winding spool assembly, a lock (not shown) may be provided on the boot, binding or strap assembly 100, and excess tightening element may be locked in the lock and stowed in a pocket to prevent the tightening element from hanging loose. As described below in more detail with reference to FIG. 6, in some embodiments, a lock may be used to hold the tension in the tightening element after the tightening element has been used to tighten a strap. For example, after pulling the tightening element, the rider locks a portion of the tightening element in the lock and the tightening element continues to maintain the tightness of the strap during riding. The lock and pocket arrangement may be similar to that disclosed in U.S. patent application Publication No. 2005/0126043 assigned to The Burton Corporation and which is hereby incorporated by reference in its entirety.

Figure 5:
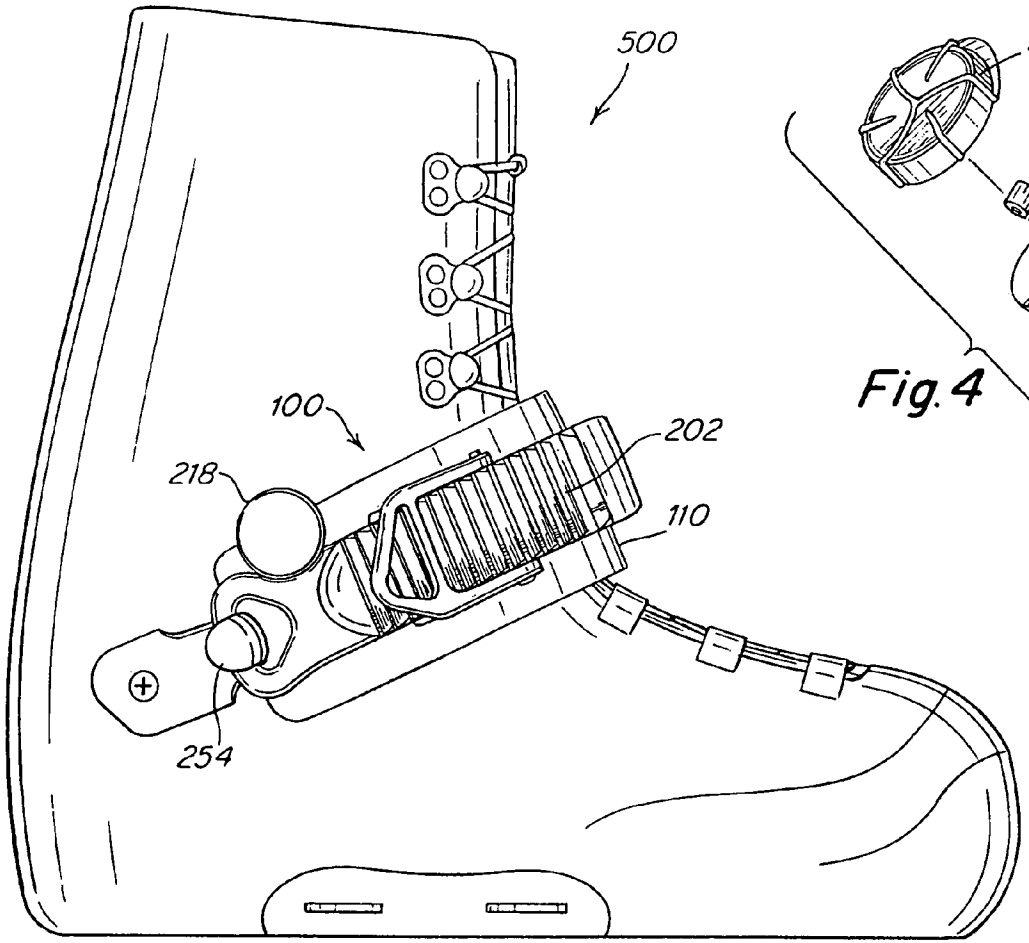
FIG. 5 is a side view a strap, in accordance with of one illustrative embodiment, configured as a boot strap.

In conventional ratchet strap assemblies, the rider inserts or removes his boot from the binding by separating the serrated strap from the padded strap. As mentioned above, the tightening element path of various embodiments described herein may prevent the sufficient separation of a serrated strap and a padded strap or otherwise may need to be sufficiently long to enable enough slack between the two strap pieces. According to one aspect of the present invention, and as illustrated in FIGS. 1A and 1B, the rider instead unhooks a catch, such as a loop 252, provided at an end of serrated strap 202, from a hook 254 provided on heel hoop 232 or baseplate sidewall 234, thus separating one end of the binding strap from the binding. After the rider removes or inserts his boot, loop 252 may be hooked back onto hook 254. It should be appreciated that a similar arrangement may be employed when the strap is used on a boot, such as shown in FIG. 5.

Any suitable sizes, shapes and materials may be used for the hook and the catch; however, examples from one particular embodiment will now be described. The loop may be made of Delrin® acetal resin available from DuPont. The material forming the portion of the loop that engages with hook 254 has an approximately circular cross-section with an outer diameter of 6.5 mm. Loop 252 includes a rounded triangular-shaped opening 16 mm long by 22 mm wide. Hook 254 is made of nylon and forms a semi-circular channel with a diameter of 6.7 mm, in which loop 252 is engaged.

In the illustrated embodiment, hook and catch assembly 250 is provided on the serrated strap piece of strap assembly 100. In some embodiments, hook and catch assembly 250 may be provided on the boot-engaging strap piece of strap assembly 100. A hook and catch assembly also may be provided on both the serrated strap piece and the boot-engaging strap piece.

The relative placement of hook 254 and loop 252 may be reversed in some embodiments such that hook 254 is provided on a strap (either the boot-engaging strap piece or the serrated strap piece) and loop 252 is provided on the base, such as on baseplate sidewall 234 or heel hoop 232. Hook 254 or loop 252 need not be provided immediately adjacent base sidewall 234 or heel hoop 232, as in some embodiments, one of hook 254 and loop 252 (whichever element is not provided at the end of the strap) may be elongated such that it extends toward the top of the boot. Hook 254 or loop 252 also need not directly attach to baseplate sidewall 234 or heel hoop 232. For example, hook 254 or loop 252 may be attached to baseplate sidewall 234 or to the boot (as shown in FIG. 5) with a strap or a cord. The particular method of attaching hook 254 or loop 252 to baseplate sidewall 234 or heel hoop 232 is not intended to be limiting. In some embodiments, the hook or loop may be integrally molded with the strap (either the engagement piece or the boot-engagement piece) or integrally molded with the binding.

Rather than configuring the engagement strap to be separable from the binding base (or boot), in an alternative embodiment, the engagement strap may be coupled to the binding base (or boot, as the case may be) and a hook or catch is disposed on the boot-engaging strap and a corresponding mating component (e.g., the other of a hook and catch) is disposed on the engagement strap such that the two strap portions can be separated from one another at the junction of the two strap pieces. In this embodiment, the locking element is suitably coupled to the binding base or boot (instead of coupled to the boot-engaging strap as shown in FIG. 1A) and the hook or catch is attached to the boot-engaging strap piece. As in the previously described embodiments, the strap is tightened by moving the engagement strap relative to the locking element. Depending on the capstan arrangement, a portion of the tightening element that is accessible for pulling may be present toward the end of the engagement strap near the baseplate or toward the end of the engagement strap closer to the hook or catch.

Figure 6:
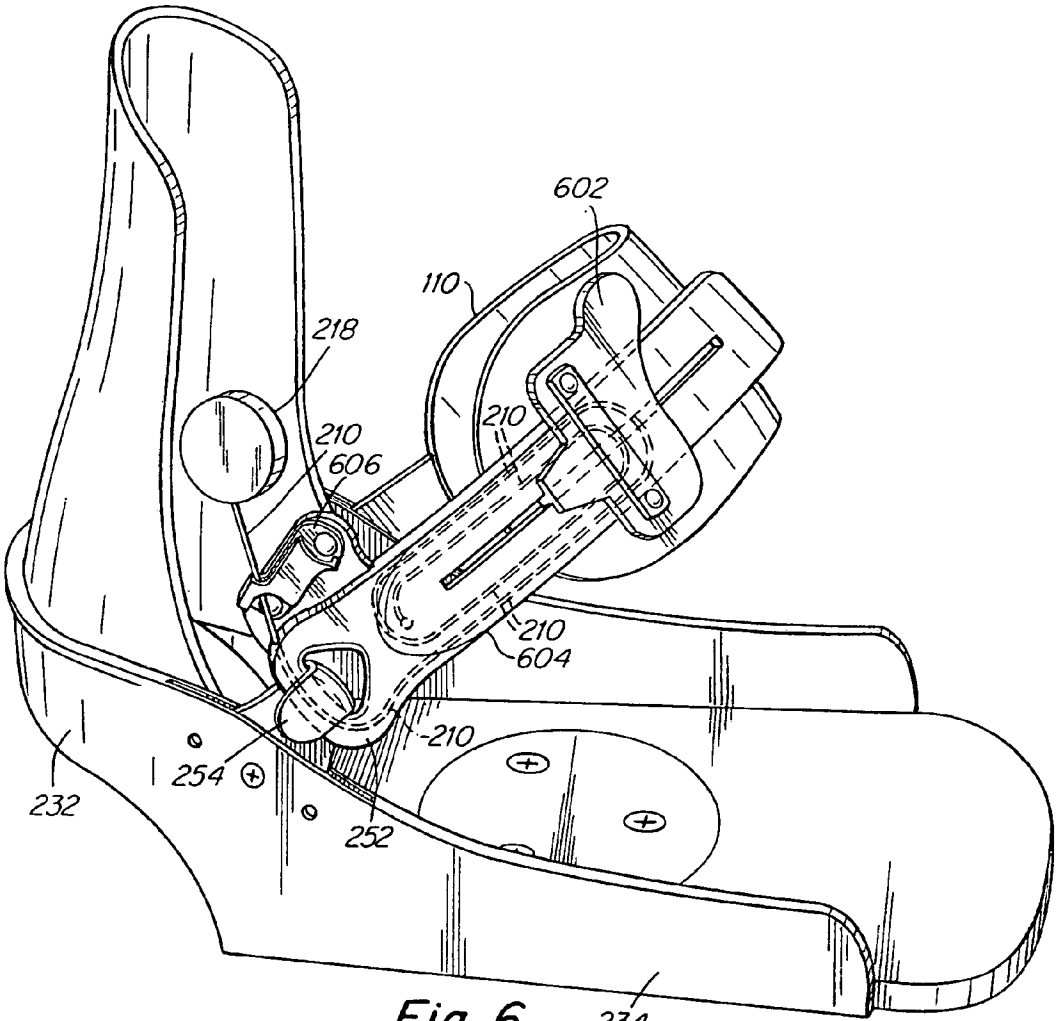
FIG. 6 is a perspective view of an alternative embodiment of the invention.

An alternative strap assembly embodiment is illustrated in FIG. 6 in which tightening element 210 is used to hold a binding strap tight during use. A slider 602 is attached to boot-engaging strap 110 and is slidable relative to slider tongue 604. In one embodiment, slider tongue includes a channel and slider 602 includes an element (not shown) to movably hold slider 602 to slider tongue 604. Tightening element 210 is coupled to slider 602, and in a manner similar to embodiments described above, a rider pulls on tightening element 210 with pull element 218, which draws slider 602, and thus boot-engaging strap 110, toward heel hoop 232. Slider 602 and/or slider tongue 604 may include one or more elements (such as a capstan assembly) to provide a suitable mechanical advantage, as described above. In the embodiment illustrated in FIG. 6, tightening element 210 wraps around two capstans (or pulleys) disposed in slider 602 to provide a mechanical advantage having a 4:1 ratio. A hook and latch arrangement, including hook 254 and latch 252, may be used for separating the binding strap from the mating component (e.g., heel hoop 232).

To hold the binding strap in a tightened configuration, and to resist forces applied to the binding strap during riding, tightening element 210 is secured in a lock, such as a cleat 606, in a tensioned state. Pull element 218 may optionally include a gathering device that gathers any excess tightening element present after tightening element 210 has been locked in cleat 606.

Embodiments of the various aspects disclosed herein have been illustrated for use with strap bindings and boots. In some embodiments, the strap assemblies and/or other features and aspects disclosed herein may be attached to other snowboard components, such as a snowboard binding interface that attaches to a boot via straps and couples to a binding via a step-in engagement member, such as that described in U.S. Pat. No. 6,722,688 and U.S. Pat. No. 6,267,390, each assigned to The Burton Corporation, and each of which is hereby incorporated herein in its entirety.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An apparatus, comprising:

a snowboard binding;

a first binding strap constructed and arranged to engage a snowboard boot and at least partially secure the boot to the binding, the first binding strap comprising an engagement strap configured as a serrated strap;

a first tightening element coupled to the first binding strap; and a first tightening element path configured to provide a mechanical advantage in tightening the first binding strap about a boot when the first tightening element is pulled, whereby a first applied force applied on the first tightening element results in a first resultant force on the first binding strap that is greater than the first applied force, wherein the first tightening element travels around at least one guide element, wherein the at least one guide element is a pulley.

2. An apparatus, comprising:

a snowboard binding;

a first binding strap constructed and arranged to engage a snowboard boot and at least partially secure the boot to the binding, the first binding strap comprising an engagement strap configured as a serrated strap;

a first tightening element coupled to the first binding strap; and a first tightening element path configured to provide a mechanical advantage in tightening the first binding strap about a boot when the first tightening element is pulled, whereby a first applied force applied on the first tightening element results in a first resultant force on the first binding strap that is greater than the first applied force, wherein the first tightening element travels around at least one guide element, wherein the at least one guide element is a capstan.

3. An apparatus as in claim 1, further comprising a cleat for securing a first end portion of the first tightening element.

4. An apparatus as in claim 1, wherein the first binding strap is an ankle strap.

5. An apparatus as in claim 1, wherein the first binding strap is a toe strap.

6. An apparatus as in claim 1, wherein the first binding strap comprises a boot-engaging strap.

7. An apparatus as in claim 6, wherein after the boot-engaging strap is tightened about the boot, the boot-engaging strap and the engagement strap are constructed and arranged to hold any tension in the first binding strap, thereby allowing release of tension in the first tightening element.

8. An apparatus as in claim 6, wherein a second end portion of the first tightening element is attached to the boot-engaging strap.

9. An apparatus as in claim 8, wherein the second end portion of the first tightening element is attached to an attachment element that is attached to the boot-engaging strap.

10. An apparatus as in claim 6, wherein a second end portion of the first tightening element is attached to the engagement strap.

11. An apparatus as in claim 1, wherein the first tightening element is routed through a first attachment element.

12. An apparatus as in claim 1, further comprising:

a second binding strap constructed and arranged to engage a snowboard boot and at least partially secure the boot to the binding, the second binding strap comprising a second engagement strap configured as a second serrated strap;

a second tightening element coupled to the second binding strap; and a second tightening element path configured to provide a mechanical advantage in tightening the second binding strap about a boot when the second tightening element is pulled, whereby a second applied force applied on the second tightening element results in a second resultant force on the second binding strap that is greater than the second applied force.

13. An apparatus as in claim 1, further comprising a retraction device adapted to gather at least a portion of the tightening element when a user releases the tightening element.

14. An apparatus as in claim 1, wherein the first binding strap further comprises one of a hook and a catch disposed at an end of the first binding strap, the hook or catch being configured to be engageable with a mating component.

15. An apparatus as in claim 1, wherein the tightening element is disposed exclusively on or within the first binding strap.

16. An apparatus, comprising:

a snowboard binding;

a first binding strap constructed and arranged to engage a snowboard boot and at least partially secure the boot to the binding, the first binding strap comprising an engagement strap configured as a serrated strap;

a first tightening element coupled to the first binding strap; and a first tightening element path configured to provide a mechanical advantage in tightening the first binding strap about a boot when the first tightening element is pulled, whereby a first applied force applied on the first tightening element results in a first resultant force on the first binding strap that is greater than the first applied force;

a second binding strap constructed and arranged to engage a snowboard boot and at least partially secure the boot to the binding, the second binding strap comprising a second engagement strap configured as a second serrated strap;

a second tightening element coupled to the second binding strap; and a second tightening element path configured to provide a mechanical advantage in tightening the second binding strap about a boot when the second tightening element is pulled, whereby a second applied force applied on the second tightening element results in a second resultant force on the second binding strap that is greater than the second applied force;

wherein a ratio of the first resultant force to the first applied force comprises a first ratio and wherein a ratio of the second resultant force to the second applied force comprises a second ratio, and wherein the first ratio is different from the second ratio.

17. An apparatus as in claim 16, wherein the first ratio is a 3:1 ratio.

18. An apparatus as in claim 16, wherein the second ratio is a 2:1 ratio.

19. An apparatus as in claim 17, wherein the second ratio is a 2:1 ratio.

20. An apparatus, comprising:

a strap constructed and arranged to engage a snowboard boot, the strap comprising a boot-engaging strap piece and an engagement strap piece;

a first tightening element coupled to the strap to tighten the strap about the boot; and at least one guide element arranged on the strap, wherein the first tightening element travels around the at least one guide element in a manner to provide a mechanical advantage in tightening the strap about a boot when the first tightening element is pulled, whereby an applied force applied on the first tightening element results in a resultant force on the strap that is greater than the applied force, wherein the at least one guide element is a pulley.

21. An apparatus, comprising:

a strap constructed and arranged to engage a snowboard boot, the strap comprising a boot-engaging strap piece and an engagement strap piece;

a first tightening element coupled to the strap to tighten the strap about the boot; and at least one guide element arranged on the strap, wherein the first tightening element travels around the at least one guide element in a manner to provide a mechanical advantage in tightening the strap about a boot when the first tightening element is pulled, whereby an applied force applied on the first tightening element results in a resultant force on the strap that is greater than the applied force, wherein the at least one guide element is a capstan.

22. An apparatus as in claim 20, further comprising a cleat for securing a first end portion of the first tightening element.

23. An apparatus as in claim 20, wherein the strap is an ankle strap.

24. An apparatus as in claim 20, wherein the strap is a toe strap.

25. An apparatus as in claim 20, further comprising a pawl attached to the boot-engaging strap, and wherein the engagement strap is a serrated strap.

26. An apparatus as in claim 20, in combination with a snowboard binding, wherein an end of the engagement strap is coupled to the binding.

27. An apparatus as in claim 20, in combination with a snowboard boot, wherein an end of the engagement strap is coupled to the boot.

28. An apparatus as in claim 20, wherein the at least one guide element comprises at least two guide elements.

29. An apparatus, comprising:

a strap constructed and arranged to engage a snowboard boot, the strap comprising a boot-engaging strap piece and an engagement strap piece;

a first tightening element coupled to the strap to tighten the strap about the boot; and at least one guide element arranged on the strap, wherein the first tightening element travels around the at least one guide element in a manner to provide a mechanical advantage in tightening the strap about a boot when the first tightening element is pulled, whereby an applied force applied on the first tightening element results in a resultant force on the strap that is greater than the applied force, wherein the at least one guide element comprises at least three guide elements.

30. An apparatus as in claim 2, further comprising a cleat for securing a first end portion of the first tightening element.

31. An apparatus as in claim 2, wherein the first binding strap is an ankle strap.

32. An apparatus as in claim 2, wherein the first binding strap is a toe strap.

33. An apparatus as in claim 2, wherein the first binding strap comprises a boot-engaging strap.

34. An apparatus as in claim 33, wherein after the boot-engaging strap is tightened about the boot, the boot-engaging strap and the engagement strap are constructed and arranged to hold any tension in the first binding strap, thereby allowing release of tension in the first tightening element.

35. An apparatus as in claim 33, wherein a second end portion of the first tightening element is attached to the boot-engaging strap.

36. An apparatus as in claim 35, wherein the second end portion of the first tightening element is attached to an attachment element that is attached to the boot-engaging strap.

37. An apparatus as in claim 33, wherein a second end portion of the first tightening element is attached to the engagement strap.

38. An apparatus as in claim 2, wherein the first tightening element is routed through a first attachment element.

39. An apparatus as in claim 2, further comprising:

a second binding strap constructed and arranged to engage a snowboard boot and at least partially secure the boot to the binding, the second binding strap comprising a second engagement strap configured as a second serrated strap;

a second tightening element coupled to the second binding strap; and a second tightening element path configured to provide a mechanical advantage in tightening the second binding strap about a boot when the second tightening element is pulled, whereby an applied force applied on the second tightening element results in a resultant force on the second binding strap that is greater than the applied force.

40. An apparatus as in claim 2, further comprising a retraction device adapted to gather at least a portion of the tightening element when a user releases the tightening element.

41. An apparatus as in claim 2, wherein the first binding strap further comprises one of a hook and a catch disposed at an end of the first binding strap, the hook or catch being configured to be engageable with a mating component.

42. An apparatus as in claim 2, wherein the tightening element is disposed exclusively on or within the first binding strap.

43. An apparatus as in claim 39, wherein a ratio of the first resultant force to the first applied force comprises a first ratio and wherein a ratio of the second resultant force to the second applied force comprises a second ratio, and wherein the first ratio is different from the second ratio.

44. An apparatus as in claim 43, wherein the first ratio is a 3:1 ratio.

45. An apparatus as in claim 43, wherein the second ratio is a 2:1 ratio.

46. An apparatus as in claim 44, wherein the second ratio is a 2:1 ratio.

47. An apparatus as in claim 21, further comprising a cleat for securing a first end portion of the first tightening element.

48. An apparatus as in claim 21, wherein the strap is an ankle strap.

49. An apparatus as in claim 21, wherein the strap is a toe strap.

50. An apparatus as in claim 21, further comprising a pawl attached to the boot-engaging strap, and wherein the engagement strap is a serrated strap.

51. An apparatus as in claim 21, in combination with a snowboard binding, wherein an end of the engagement strap is coupled to the binding.

52. An apparatus as in claim 21, in combination with a snowboard boot, wherein an end of the engagement strap is coupled to the boot.

53. An apparatus as in claim 21, wherein the at least one guide element comprises at least two guide elements.

54. An apparatus as in claim 12, wherein a ratio of the first resultant force to the first applied force comprises a first ratio and wherein a ratio of the second resultant force to the second applied force comprises a second ratio, and wherein the first ratio is different from the second ratio.

55. An apparatus as in claim 54, wherein the first ratio is a 3:1 ratio.

56. An apparatus as in claim 54, wherein the second ratio is a 2:1 ratio.

57. An apparatus as in claim 55, wherein the second ratio is a 2:1 ratio.

* * * * *